US006613419B2

(12) United States Patent
Ohbayashi et al.

(10) Patent No.: US 6,613,419 B2
(45) Date of Patent: Sep. 2, 2003

(54) INK JET RECORDING SHEET

(75) Inventors: Keiji Ohbayashi, Tokyo (JP); Kenichi Yoshitsuka, Kanagawa-ken (JP)

(73) Assignee: Konica Corporation, Tokyo (JP)

( * ) Notice: Subject to any disclaimer, the term of this patent is extended or adjusted under 35 U.S.C. 154(b) by 58 days.

(21) Appl. No.: 09/872,833

(22) Filed: Jun. 1, 2001

(65) Prior Publication Data

US 2002/0025413 A1 Feb. 28, 2002

(30) Foreign Application Priority Data

Jun. 9, 2000 (JP) ..... 2000-173595

(51) Int. Cl.[7] ..... B41M 5/00
(52) U.S. Cl. ..... 428/195
(58) Field of Search ..... 428/195

(56) References Cited

U.S. PATENT DOCUMENTS 6,326,055 B1 * 12/2001 Arai et al. ..... 427/195
6,436,515 B1 * 8/2002 Ohbayashi et al. ..... 428/195

FOREIGN PATENT DOCUMENTS

EP 1146170 A1 * 10/2001 ..... D21H/19/28

* cited by examiner

*Primary Examiner*—Pamela R. Schwartz
(74) *Attorney, Agent, or Firm*—Frishauf, Holtz, Goodman & Chick, P.C.

(57) ABSTRACT

An ink jet recording sheet is disclosed, comprising a support having on at least one side of the support an ink absorbing layer, wherein the surface of the ink absorbing layer side of the sheet exhibits a center-line mean roughness (Ra) of 0.4 to 2.5 $\mu$m and a ten-point mean roughness (Rz) of 5×Ra to 20×Ra when measured at a reference length of 2.5 mm and a cut-off value of 0.8 mm.

11 Claims, No Drawings

INK JET RECORDING SHEET

FIELD OF THE INVENTION

The present invention relates to ink jet recording sheets exhibiting high image quality and in particular to ink jet recording sheets which are improved in glare due to surface gloss to minimize difference in gloss between images and which provides an ink jet print having a high grade feel.

BACKGROUND OF THE INVENTION

Along with rapid technological innovation in ink jet recording, its print quality is comparable with that of silver salt photographic prints. The print quality achieved by ink jet recording depends on three factors: the printer, the ink and the recording sheet. Specifically, recent technological innovation of the former two factors is marked from the view point of image quality and the difference in performance of the ink jet recording sheet (hereinafter, also noted simply as recording sheet) is very important for final print quality.

To obtain ink jet prints close to silver salt photographic prints, various improvements have been made from the view-point of the recording sheets. Specifically, an ink jet recording sheet which comprises a paper base covered with polyolefin such as polyethylene on both sides thereof, having thereon an ink absorbing layer, has recently spread widely in terms of being relatively low in cost, compared to plastic films, and as a print with a high grade feel, close to silver salt photography in massiveness, softness, flatness and glossiness.

Ink jet recording sheets are mainly classified into those which exhibit ink-absorptivity, such as paper and those which comprise a support having thereon an ink absorbing layer. In the former case, ink directly permeates into the support, so that problems occurred in that high maximum density could not be obtained, or the support absorbs an ink solvent, causing wrinkles in the images and high grade prints could not be obtained.

Ink-absorbing layers provided on the support are those generally classified into a swelling type and a void-type. The swelling type ink absorbing layer is mainly comprised of hydrophilic polymer such as gelatin, polyvinyl alcohol, polyvinyl pyrrolidine or polyethylene oxide. Although there are several methods for preparing the void-type ink absorbing layer, the representative void-type ink absorbing layer is a layer containing a small amount of a hydrophilic polymer and a large amount of fine particles, so that voids are formed among the particles.

Texture sometimes depends on personal taste but glossiness or other characteristics necessary for a print having a high grade feel are sometimes required according to its intended use. For example, there are such cases that fingerprint resistance, reduced tackiness or paste stain and to avoid strong light reflection making low quality appearing images.

To respond to such desires, there are known ink jet recording sheets having a matte or semi-matte surface resulting in lowered glossiness. As a technique for making the surface semi-matte are known providing an ink absorbing layer on the matted support or incorporation of a matting agent into the ink absorbing layer surface. In either case, it is common to form protrusions of heights of the 1 $\mu$m order on the ink absorbing layer surface. When ink jet printing is made on a recording sheet obtained by optimally roughing the surface, however, problems are produced such that glossiness varies from image to image, resulting in non-uniform glossiness. Such problems deteriorate print quality of ink jet prints superior in high grade feel, for which an improvement thereof is desired.

Although its cause is not fully understood, it is supposed that when an ink jet recording is made, a low-volatile organic solvent remains in the ink absorbing layer, producing a difference in gloss among fine protruding images on the surface. When such non-uniform difference in gloss of the images is present on the semi-matte surface, surface glare is produced on the images, making the print unnatural and losing its high grade appearance.

Such a problem is more marked when the support does not absorb the ink solvent, but even when the support absorbs the ink solvent, ink jet printing produces a slight difference among protrusions on the print surface, resulting in a difference in gloss among successive images. The problem is likely to become more marked when printing with a pigment ink. Thus, when printing with a pigment ink, the image is fixed with swollen pigment particles, resulting in lowered gloss or producing coagulated pigment particles exhibiting metallic gloss. In cases when printing with a pigment ink which inherently tends to cause variation in gloss and when protrusions are formed on the surface with a matting agent to control glossiness, the gloss difference tends to be further contrasted.

SUMMARY OF THE INVENTION

In view of the foregoing, the present invention was achieved. It is an object of the present invention to provide an ink jet recording sheet reduced in surface glare, without forming a marked difference in gloss between printed and non-printed areas, achieving images with a high grade feel and forming uniform images.

The above object of the invention can be accomplished by the following constitution:

1. An ink jet recording sheet, characterized in that the surface of the ink absorbing layer side of the sheet exhibits a center-line mean roughness (Ra) of 0.4 to 2.5 $\mu$m and a ten-point mean roughness (Rz) of 5×Ra to 20×Ra when measured at a reference length of 2.5 mm and a cut-off value of 0.8 mm;
2. The ink jet recording sheet described in 1, characterized in that a support is paper coated with polyolefin resin on both sides thereof;
3. The ink jet recording sheet described in 1 or 2, characterized in that the ink absorbing layer is a porous coat containing voids.

DETAILED DESCRIPTION OF THE INVENTION

The ink jet recording sheet according to this invention has an ink absorbing layer on a support.

As supports for use in the recording sheet of the invention can be used any one of water absorbing supports and non-water-absorbing support, of which the non-water-absorbing support is preferred, since it can form semi-glossy surface without wrinkling. The water absorbing support usable in this invention is typically a support mainly made of natural pulp but may also a mixture of synthetic pulp and natural pulp.

Examples of the non-water-absorbing support include a plastic resin film support and a paper support covered on both sides with plastic resin film. The plastic resin film support include, for example, polyester film, polyvinyl chloride film polypropylene film, cellulose acetate film and polystyrene film. The plastic rein film support may be transparent or semi-transparent, of which the transparent support is preferred. In this invention, a preferred support is a paper support having both sides of paper covered with a plastic resin (or plastic resin double coated paper support), of which polyolefin resin double coated paper support is more preferred.

The polyolefin resin double coated paper support (hereinafter, also denoted as polyolefin resin coated paper) will now be described in detail. Raw paper of the paper support is generally made of a wood pulp raw material and may optionally include a synthetic pulp such as polypropylene or synthetic fibers such as nylon or polyester. Preferred examples of the wood pulp include LBKP, LBSP, NBKP, NBSP, LDP, NDP, LUKP and NUKP. It is preferred to use large proportions of LBKP, NBSP, LBSP, NDP or LDP, each mainly having high proportions of shorter fibers. The proportion of LBSP or LDP is preferably between 10% and 70% by weight. The pulp is preferably chemical pulp (e.g., sulfate pulp, sulfite pulp), since they have negligible impurities. Pulp which is subjected to a bleaching treatment to enhance whiteness, may also be employed.

To the raw paper, there may optionally be added a sizing agent such as a higher fatty acid or alkylketene dimer; a white pigment such as calcium carbonate, talc or titanium white; a paper-strengthening agent such as starch, polyacrylamide or polyvinyl alcohol; a fluorescent brightening agent; a moisture-holding agent such as polyethylene glycol; a dispersing agent; or a softening agent such as a quaternary ammonium salt.

Water freeness of the pulp used in paper-making is preferably 200 to 500 cc, as defined in CSF. The sum of the weight percentage of 24 mesh residue and the weight percentage of 42 mesh residue with respect to the fiber length, based on JIS-P-8207, is preferably between 30 and 70%. The 4 mesh residue is preferably not more than 20% by weight.

The weight of raw paper is preferably 50 to 250 g/m$^2$, and more preferably 70 to 200 g/m$^2$. The raw paper may be subjected to calender treatment, during or after the paper-making process, to provide enhanced smoothness. The density of raw paper is generally 0.7 to 1.2 g/m$^2$, based on JIS-P-8118. The rigidity of raw paper is preferably 20 to 200 g, based on JIS-P-8143. The surface of the raw paper may be coated with a sizing agent. As the sizing agent is employed one which is added into the interior of the raw paper, as described above. The pH of the raw paper is preferably 5 to 9 in the case when measured in the hot water extraction method, as defined in JIS-P-8113.

Next, the polyolefin resin double coated paper will be described. Examples of the polyolefin resin used for this purpose include polyethylene, polypropylene, polyisobutylene, and copolymer mainly comprised of ethylene and propylene. Of these is preferred polyethylene.

Polyethylene will now be further described. As polyethylene, coated on the surface or the back of the raw paper, a low density polyethylene (LDPE) and/or a high density polyethylene (HDPE) are mainly used, however, other linear low density polyethylenes (LLDPE) or polypropylene may also be used. As widely used in the photographic art, a polyethylene layer coated on the side of the ink absorbing layer preferably contains, within the polyethylene, rutile type or anatase type titanium oxide to improve opacity or whiteness. The content of the titanium oxide is preferably 3 to 20% by weight, and more preferably 4 to 13% by weight.

Heat-resistant pigments or fluorescent brightening agents may be incorporated into the polyolefin layer to adjust the background whiteness. Examples of the pigment include ultramarine blue, Prussian blue, cobalt blue, phthalocyanine blue, manganese blue, cerulean blue, tungsten blue, molybdenum blue, and anthraquinone blue. Examples of the fluorescent brightening agent include dialkylaminocoumalin, bisdimethylaminostilbene, bismethylaminostilbene, 4-alkoxy-1,8-naphthalenedicarboxylic acid-N-alkylimide, bisbenzoxazolylethylene, and dialkylstilbene.

The amount of polyethylene coated on the surface or the back of the raw paper is so controlled that there is no curling when aged under high humidity or low humidity, after forming the ink absorbing layer and the backing layer. The thickness of the polyethylene layer on the side of the ink absorbing layer is preferably 15 to 40 $\mu$m and that on the side of the backing layer is preferably 10 to 30 $\mu$m.

In the invention, a polyethylene-coated paper support having the following characteristics is preferably employed:

(1) Tensile strength: i.e., strength of 2 to 30 Kg in the longitudinal direction and 1 to 20 Kg in the lateral direction, as defined in JIS-P-8113 (or ISO 1924-1:1992 and ISO 1924-2:1992);

(2) Tear strength: 10 to 200 g in the longitudinal direction and 20 to 200 g in the lateral direction, as defined in JIS-P-8116 (or ISO 1974:1990);

(3) Compression elastic modulus of 103 Kgf/cm$^2$ or more;

(4) Opacity: 80% or more and preferably 85% or more when measured by the method as defined in JIS-P-8138;

(5) Whiteness: L*, a* and b* meet the following requirements, as defined in JIS-Z-8729, $$L^*=80 \text{ to } 95,\ a^*=-3 \text{ to } +5, \text{ and } b^*=-7 \text{ to } +2;$$

(6) Clark stiffness: preferably 50 to 300 cm$^3$/100 in the transport direction of the recording sheet, as defined in JIS P 8143;

(7) Moisture content of raw paper: preferably 4 to 10% by weight with respect to the raw paper.

The recording sheet of this invention has regular or irregular, fine grained protrusions (or peaks and valleys) on the surface of the ink absorbing layer. Surface gloss is optimally lowered by the protrusions, minimizing unwanted surface glare, whereby prints exhibiting little difference in glossiness between printed and unprinted areas when recorded by an ink jet printer and providing a visual high grade appearance can be obtained. Such characteristics achieved by this invention cannot be accomplished simply by incorporating matting agents used in the ink absorbing layer into an inherently flat ink absorbing layer. Thus, the recording sheet can be obtained by providing surface protrusions of specific sizes, which is distinct from that achieved by using conventional matting agents.

As mentioned earlier, the surface roughness of the ink absorbing layer requires protrusions meeting the requirement that the center-line mean roughness (Ra) is 0.4 to 2.5 $\mu$m and the ten-point mean roughness (Rz) is within the range of 5×Ra to 20×Ra when measured at a reference length of 2.5 mm and a cut-off value of 0.8 mm, as defined in JIS-B-0601, or in ISO 468-1982, ISO 3274-1975, ISO 4287/1-1984, ISO 4287/2-1984, and ISO 4288-1985. Advantageous effects of this invention can be achieved only when the Ra and Rz meet the foregoing requirements.

The center-line mean roughness (Ra), which is also called an arithmetic mean roughness, is a parameter representing an averaged value of surface roughness caused by protrusions (or peaks and valleys) on the surface. The higher this value, the larger the average roughness. The ten-point mean roughness is a parameter representing a local roughness at the position exhibiting specifically larger protrusions. The more the ratio of the ten-point mean roughness to the center-line mean roughness, the less the contribution of the local protrusions (or local peaks and valleys). Thus, the higher the Rz/Ra, the longer the period of the larger protrusion being formed of the surface, increasing the surface waviness component. On the contrary, the lower the Rz/Ra, the heights of the protrusions (or distances of peak to valley) are averaged out, tending to lower gloss.

Alternatively, the center-line mean roughness (Ra), when the roughness curve has been expressed by y=f(x), is a value, expressed in micrometer (μm), that is obtained from the following formula, extracting a part of reference length L in the direction of its center-line from the roughness curve, and taking the center-line of this extracted part as X-axis and the direction vertical magnification as Y-axis:

$$Ra = \frac{1}{L}\int_0^L |f(x)|dx$$

The ten-point mean roughness is the value of difference, expressed in micrometer (μm), between the mean value of altitudes of peaks from the highest to the 5th, measured in the direction of vertical magnification from a straight line that is parallel to the mean line and that does not intersect the profile, and the mean value of altitudes of valleys from the deepest to the 5th, within a samples portion, of which length corresponds to the reference length, from the profile.

The center-line mean roughness (Ra) can be determined, for example, in such a manner that measuring samples are allowed to stand in an atmosphere of 25° C. and 65% RH for 24 hrs. and then measured under the same atmosphere. As a measurement apparatus is cited, for example, RST/PLUS non-contact type three-dimensional micro surface shape measuring system, available from WYKO Co.

When the Ra is less than 0.4 μm, surface glare is no longer prevented, and when the Ra exceeds 2.5 μm, ink tends to puddle in the depressions, resulting in mottled unevenness. In cases where the ink absorbing layer is a porous layer having voids and specifically when the Ra exceeds 2.5 μm, cracking tends to occur in the layer during the preparation thereof. When the Rz/Ra is less than 5, glossiness is likely to be lowered and gloss of the image is likely to be markedly varied, leading to an increase in glare. When the Rz/Ra exceeds 20, local protrusions are too high, likely causing troubles such as white spots during preparation or printing. The Ra is preferably 0.5 to 2.0 μm, the Rz/Ra is preferably 7 to 15, and the Rz is preferably 3 to 25 μm.

The maximum height of the ink absorbing layer (Rmax) is preferably 4 to 30 μm. The protrusions on the surface of the ink absorbing layer may be formed by providing an ink absorbing layer on the previously embossed support or by providing an ink absorbing layer on a flat support and then subjecting the surface thereof to an embossing treatment, but the former is preferred in view of the fact that it is rather difficult to provide uniform protrusions when subjecting the embossing treatment after coating the ink absorbing layer. In the case of the ink absorbing layer being a relatively hard porous layer, the former is specifically preferred.

Specifically, in the case of a support having polyolefin on both sides of a paper base, i.e., a polyolefin double coated paper support, it is preferred to subject the resin surface to the embossing treatment after coating the polyolefin resin.

In such a case, the ink absorbing layer thickness is preferably not less than 10 μm in terms of ink absorptivity, and is also preferably not more than 60 μm in terms of prevention of cracking.

Embossing the polyolefin resin surface is exemplarily performed in such a manner that after extrusion-coating polyolefin melt on a paper base, the resin surface is compressed by an embossing roller to provide fine texture. Embossing methods include, for example, a method of subjecting resin coated paper obtained by melt-extrusion at room temperature and a method of forming peaks and valleys using a cooling roll having an engraved pattern on the surface with cooling at the time when extrusion-coating polyolefin resin. The latter is preferred because embossing can be done at a relatively low pressure and precise and uniform embossing is also feasible. Varying the shape of the peak and valley on the surface of a support can be made preferably using the above-described cooling rolls by varying the size, shape or height of the peak and valley.

Although the relationship between the support surface and the ink absorbing layer surface with respect to their peak and valley depends on characteristics of the ink absorbing layer, in cases where the ink absorbing layer is a void containing porous layer exhibiting a high ink absorbing speed and is capable of providing high quality prints, the dry layer thickness is increased so that the distance of peak to valley on the surface is likely to decrease.

In the case of an ink jet recording sheet obtained by coating an ink absorbing layer on a support having peaks and valleys on the surface, surface roughness of the support needs to be greater than the intended peak to valley distance on the surface of the ink absorbing layer. Thus, a support having regular or irregular shaped surface is preferred, exhibiting the surface roughness of a center-line mean roughness (Ra) of 0.6 to 4.0 μm, a ten-point mean roughness (Rz) of 4 to 30 μm and Ra/Rz of 5 to 30 when measured at a reference length of 2.5 mm and a cut-off value of 0.8 mm in accordance with JIS-B-0601. The support is specifically preferred, exhibiting the Ra of 1.0 to 3.5 μm and the Rz of 5 to 25 μm.

The surface of the ink absorbing layer side of the recording sheet obtained using such a support preferably exhibits a specular glossiness, at an angle of 60 degrees, (also denoted as a specular glossiness at 60°) of 10 to 35%, as defined in JIS-Z-8741, or ISO 2813 (1994) and ISO 7668 (1986). The specular glossiness is affected by the foregoing surface roughness of the support, the fine structure of the ink absorbing layer and the auxiliary matting agent. In cases when the glossiness is less than 10%, the surface is usually excessively matted, often forming blurred images or after ink jet recording, a slight difference in gloss between images results in noticeable uneven gloss (or glare) noticeable. In cases when the glossiness exceeds 35%, the surface gloss of images is enhanced, exceeding the level of a semi-glossy surface, thus, the glossiness is more preferably 12 to 30%. In cases where there is a difference in glossiness between imaging and non-imaging areas, a difference of not more than 5% is acceptable in practical use but the difference of more than 5% produces problems such that glare is increased and imagewise matting lowers print quality. Specifically, a difference of more than 10% produces serious problems in print quality.

A matting agent may be incorporated into the uppermost surface of the ink absorbing layer, within the range of not deteriorating gloss. There is preferably used a matting agent having a mean particle size of 1 to 30 μm, and more preferably 2 to 20 μm.

Next, the ink absorbing layer provided on the support will be described. The ink absorbing layer may be provided on one or both sides of the support. The ink absorbing layers provided on both sides of the support may be the same or different. As described earlier, the ink absorbing layer is mainly classified as a swelling type ink absorbing layer or a void-type ink absorbing layer.

The swelling type ink absorbing layer is mainly comprised of a hydrophilic polymer capable of swelling in a solvent incorporated in ink. Examples of such a hydrophilic polymer include gelatin (e.g., alkali-processed gelatin, acid-processed gelatin, gelatin derivatives in which an amino group is modified with phenyl isocyanate or anhydrous phthalic acid, etc.), polyvinyl alcohol, (preferably having an average polymerization degree of 300 to 4,000 and a saponification degree of 80 to 99.5%), polyvinyl pyrrolidone, polyethyleneoxide, hydroxyethylcellulose, agar, pullulan, dextran, polyacrylic acid, carboxymethyl cellulose, casein, and alginic acid. These compounds may be used alone or in combination. The swelling type ink absorbing layer may contain fine inorganic particles or fine organic particles within the range providing no effect on swelling of the hydrophilic polymer and preferably and preferably in an amount of not more than 100% by weight, based on hydrophilic binder. The content of the hydrophilic polymer in the swelling layer is preferably 3 to 20 g, and more preferably 5 to 15 g per $m^2$ of the recording sheet.

The void-type ink absorbing layer is preferably a porous coat comprising a void layer containing fine inorganic particles and a small amount of a hydrophilic polymer.

Examples of the fine inorganic particles include inorganic white pigments, such as precipitated calcium carbonate light, calcium carbonate heavy, magnesium carbonate, kaoline, clay, talc, calcium sulfate, barium sulfate, titanium dioxide, zinc oxide, zinc hydroxide, zinc sulfide, zinc carbonate, hydrotalcite, aluminum silicate, diatomite, calcium silicate, magnesium silicate, synthetic amorphous silica, colloidal silica, alumina, colloidal alumina, pseudo-boehmite, aluminum hydroxide, lithopone, zeolite and magnesium hydroxide.

The fine inorganic particles may be dispersed uniformly in the form of primary particles as they are, or in the form of secondary coagulated particles. The fine inorganic particles can be of almost any size but the mean particle size is preferably not more than 1 μm, more preferably not more than 200 nm, and still more preferably not more than 100 nm in terms of glossiness and color forming property. The mean particle size is also preferably not less than 3 nm, and more preferably not less than 5 nm.

In this invention, silica and pseudo-boehmite are preferred in terms of their capability of forming fine voids. Specifically, silica, colloidal silica and pseudo-boehmite, which are prepared by a gas phase and exhibit a mean particle size of not more than 100 μm, are preferred. Further, silica prepared by a gas phase process, exhibiting a mean particle size of not more than 100 μm is more preferred to effectuate the invention. The mean particle size of the inorganic particles can be determined in the following manner. Thus, Particles themselves and the section or surface of the void layer are electron-microscopically observed and at least 100 arbitrarily selected particles are measured with respect to particle size to determine a simple mean value thereof (i.e., number average value). Herein, the particle size is represented by a diameter of a circle having an area equivalent to the particle projected area.

The hydrophilic polymer used in the void layer is the same as used in the swelling type ink absorbing layer. The specifically preferred hydrophilic polymer is polyvinyl alcohol. The weight ratio of inorganic particles to hydrophilic polymer, represented in terms of inorganic particles: hydrophilic polymer is preferably within the range of 2:1 to 20:1, and more preferably 3:1 to 10:1. Preferred examples of polyvinyl alcohol include conventional polyvinyl alcohol obtained through hydrolysis of polyvinyl acetate, polyvinyl alcohol containing a cation-modified endo-group, and an anion-modified polyvinyl alcohol containing an anionic group. The polyvinyl alcohol obtained through hydrolysis of polyvinyl acetate preferably has an average polymerization degree of not less than 300, and more preferably 1,000 to 5,000. The saponification degree is preferably 70 to 100%, and more preferably 80 to 99.5%.

In cases where the void layer contains polyvinyl alcohol as a hydrophilic polymer, boric acids or their salts may be incorporated thereto to improve film-forming property of the layer and enhance film strength. Boric acids or their salts refer to oxygen acids (or oxo-acids) containing a boron atom as a central atom and their salts, including, for example, orthoboric acid, meta-boric acid, hypoboric acid, tetraboric acid, pentaboric acid and their salts. The content of the boric acid or its salt, depending on the content inorganic particles or hydrophilic polymer in the coating solution is usually 1 to 60% by weight, and preferably 5 to 40% by weight, based on the hydrophilic polymer.

Further, an organic hardener such as an epoxy type hardener, an aldehyde type hardener, an isocyanate type hardener, an ethyleneimino type hardener and a melamine type hardener may be used in combination with the foregoing boric acid type hardener.

In this invention, the ink absorbing layer is preferably a porous coat containing voids, which exhibits a high ink-absorbing speed, minimizing uneven images and in which the hydrophilic polymer content is relatively low, reducing curling. The porous coat preferably has a void fraction (or porosity) of 40 to 80% and the void diameter of the porous coat is preferably 0.005 to 0.030 μm in terms of a median diameter. The void fraction and the void median diameter can be determined in such a manner that a coating solution of a transparent porous layer is coated on a transparent film and the obtained coat is measured by means of a mercury porosimeter (Borecizer 9320-PC2, available from SHIMAZU SEISAKUSHO Co., Ltd.)

In addition to the foregoing additives, various additives may be incorporated. Specifically, cationic mordants are preferred to improve water resistance and humidity resistance after printing. The cationic mordants include polymeric mordants containing a primary to tertiary amino group or quaternary ammonium base. Of these, polymer mordants containing a quaternary ammonium base are preferred in terms of having less discoloration or deterioration of light fastness after storage and sufficiently high capability of fixing dye colors. The preferred polymer mordants can be obtained as a homopolymer of a monomer containing the quaternary ammonium base and its copolymer with another monomer.

In addition to the foregoing, various additives commonly known in the art may be incorporated, including, for example, UV absorbents described in JP-A 57-74193, 57-87988 and 62-261476 (hereinafter, the term, JP-A means an unexamined, published Japanese Patent Application); anti-discoloring agents described in JP-A 57-7419257-87989, 60-72785, 61-146591, 1-95091 and 3-13376; anionic, cationic and nonionic surfactants; fluorescent brightening agents described in JP-A 59-42993, 59-52689, 62-280069, 61-24287 and 4-219266; defoaming agents, lubricants such as diethylene glycol, antiseptic agents, thickening agents, anti-static agents, and matting agents.

Prior to coating the ink absorbing layer on the support, the support is preferably subjected to a corona discharge treatment or subbing treatment to enhance adhesion strength between the support and the coating layer.

On the opposite side to the ink absorbing layer of the recording sheet, there may be provided various backing layers for the purpose of anti-curling or prevention of adhesion or ink transfer. Constituents of the backing layer are variable with the kind or thickness of a support or the constitution or thickness of the ink absorbing layer side but in general, a hydrophilic binder or hydrophobic binder is used therein. The backing layer thickness is usually 0.1 to 10 μm. It is preferred to roughen the backing layer surface for prevention of adhesion to another recording sheet and improvements in writability and transportability in an ink jet recording apparatus. For this purpose are preferably employed fine organic or inorganic particles having sizes of 2 to 20 μm. The backing layer may be provided before or after coating the coating composition of this invention. Surface roughness of the backing layer is preferably Ra of 0.4 to 5 μm, Rz of 1 to 30 μm, Rmax of 2 to 40 μm and a glossiness of 5 to 30%.

The ink absorbing layer is coated preferably by a roll coating method, rod bar coating method, air-knife coating method, spray coating method, curtain coating method or extrusion coating method using a hopper described in U.S. Pat. No. 2,681,294.

In cases where polyolefin resin coated paper is used as a support, drying is preferably carried out at a temperature of 0 to 80° C. The temperature exceeding 80° C. softens the polyolefin resin, often making transport difficult or producing uneven gloss on the recording layer surface. The preferred drying temperature is 0 to 60° C.

The ink absorbing layer relating to this invention preferably exhibits the following characteristics:

Bekk surface smoothness: 300 to 2,000 sec (ink absorbing layer side) and 300 to 1,000 sec (backing layer side), in which the Bekk smoothness (or smmothness by Bekk method) is defined in JIS P 8119 or ISO 5627:1995;

friction coefficient: coefficient of dynamic friction of 0.2 to 0.8 for both surface sides;

background whiteness (for both sides): L*=88 to 96, a*=−3 to +3, b*=−8 to +3, defined in CIE 1976 (L*a*b*) color spaces; and opacity: 88 to 98%.

In ink jet recording sheets according to this invention, water-based dye inks and water-based pigment inks are preferably used but oil-based pigment inks are also applicable.

EXAMPLES

The present invention will be described based on examples but embodiments of the invention are by no means limited to these. In Examples, "%" means percentage by absolute dry weight.

Example 1

On the back face of photographic raw paper having a moisture content of 4.5% by weight and a weight of 190 g/m$^2$, low density polyethylene having a density of 0.92 was coated in a thickness of 35 μm by the extrusion coating. Then, on the front face, low density polyethylene having a density of 0.92 and containing anatase type titanium oxide of 9.5% by weight was coated in a thickness of 40 μm by the melt extrusion coating to prepare polyethylene double coated support. Immediately after the melt extrusion coating, the polyethylene surface of the support was subjected to various embossing treatments with cooling, using a cooling roll having a regular peak to valley height. The differentiation of embossing was made by adjusting the density or the peak to valley height. After subjected to a corona discharge treatment, the front face of the support was coated with a hardener containing gelatin sublayer of 0.03 g/m$^2$. The back face, after subjected to a corona discharge treatment, was also coated with a latex layer of 0.2 g/m$^2$. The thus obtained back faces of the supports exhibited Ra of 1.02, Rz of 13.2 and a Beck surface smoothness of 250 to 400 sec.

Next, there were prepared coating solutions having the following composition, for an ink absorbing layer on the front side.

Preparation of Titanium Oxide Dispersion-1

To 90 lit. of an aqueous solution exhibiting a pH of 7.5 and containing 150 g of sodium tripolyphosphate, 500 g of polyvinyl alcohol (PVA235, available from KURARAY Co., Ltd.)150 g of cationic polymer (P-1) and 10 of a defoaming agent (SN381, silicone type compound, available from SANNOBUCO Co., Ltd.) was added 20 kg of titanium oxide having an average particle size of 0.25 μm (W-10, available from ISHIHARA SANGYO Co., Ltd.) and dispersing with a high pressure homogenizer (produced by SANWA KOGYO Co., Ltd.), the total volume was made to 100 lit.

P-1

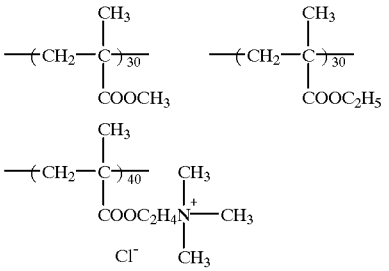

Mn = 130,000

Preparation of Silica Dispersion-1

Using Jet-stream Inductor Mixer TDS (available from MITAMURA RIKEN KOGYO Co., Ltd.), 125 kg of silica prepared by a gas phase process, having an average primary particle size of 0.014 μm (QS-20, available from TOKUYAMA Co.) was dispersed by aspiration dispersion in 600 lit. of water adjusted to a pH of 2.5 with nitric acid at room temperature, then the total volume was made to 660 lit.

Preparation of Silica Dispersion-2

To 15 lit of an aqueous solution (pH=2.3) containing 1.29 g of cationic polymer (P-1), 4.2 lit. of ethanol and 1.5 lit. of n-propanol was added 66.0 lit. of silica dispersion-1 with stirring, then, 6.0 lit. of an aqueous solution containing 260 g of boric acid and 230 g of borax was added thereto and 1 g of the above-described defoaming agent, SN381 was further added. The mixture was dispersed using a high-speed homomixer at a rate of 12,000 rpm and water was added to make the total volume of 90 lit to obtain silica dispersion-2.

Preparation of Emulsifying Dispersion-1

In 3,000 g of diisodecyl phthalate and 12 lit. of ethyl acetate were dissolved 400 g of an oil-soluble fluorescent brightening agent (UVITEX-OB, available from Chiba- Geigy Co.)6,000 g of antioxidant AO-1 with heating and further added to 35 lit. aqueous solution containing 3500 g of acid-processed gelatin, cationic polymer (P-1) and 4000 ml of 50% saponin aqueous solution. The mixture was dispersed with a high-pressure homogenizer (produced by SANWA KOGYO Co., Ltd.) and after removing ethyl acetate under reduced pressure, the total volume was made to 50 lit.

Preparation of Matting Agent Dispersion-1

To 7 lit. of water containing 3 g of the foregoing PVA235, 156 g of methacrylic acid ester type monodisperse matting agent (MX-1500, average particle size of 15 μm, available from SOKENKAGAKU Co., Ltd.) was added and dispersed with a high-speed homogenizer, then, the total volume was made to 7.8 lit.

Preparation of Coating Solution

Coating solutions for the 1st, 2nd and 3rd layers were each prepared according to the following procedures.

Preparation of 1st Layer Coating Solution

To 560 ml of silica dispersion-2, the following additives were successively added with stirring at 40° C.

| | | |
|---|---|---|
| (1) | 10% Polyvinyl alcohol aq. solution (PVA203, available from KURARAY Co., Ltd.) | 6 ml |
| (2) | 5% Polyvinyl alcohol aq. solution (PVA235, available from KURARAY Co., Ltd.) | 170 ml |
| (3) | 5% Polyvinyl alcohol aq. solution (PVA245, available from KURARAY Co., Ltd.) | 120 ml |
| (4) | Emulsifying dispersion-1 | 22 ml |
| (5) | Titanium oxide dispersion-1 | 40 ml |
| (6) | Latex emulsion AE-803 (acrylic acid ester type copolymer compound, available from DAIICHI KOGYO Co., Ltd.) | 24 ml |
| (7) | Pure water to make | 1000 ml |

Preparation of 2nd Layer Coating Solution

To 650 ml of silica dispersion-2, the following additives were successively added with stirring at 40° C.

| | | |
|---|---|---|
| (1) | 10% Polyvinyl alcohol aq. solution (PVA203, available from KURARAY Co., Ltd.) | 0.6 ml |
| (2) | 5% Polyvinyl alcohol aq. solution (PVA235, available from KURARAY Co., Ltd.) | 150 ml |
| (3) | 5% Polyvinyl alcohol aq. solution (PVA245, available from KURARAY Co., Ltd.) | 120 ml |
| (4) | Emulsifying dispersion-1 | 30 ml |
| (5) | Parafix EP (available from OHARA PARADIUM Co., Ltd) | 16 ml |
| (6) | Pure water to make | 1000 ml |

Preparation of 3rd Layer Coating Solution

To 650 ml of silica dispersion-2, the following additives were successively added with stirring at 40° C.

| | | |
|---|---|---|
| (1) | 10% Polyvinyl alcohol aq. solution (PVA203, available from KURARAY Co., Ltd.) | 0.6 ml |
| (2) | 5% Polyvinyl alcohol aq. solution (PVA235, available from KURARAY Co., Ltd.) | 270 ml |
| (3) | Silicone dispersion (BY-22-839, available from Toray-Dow Corning Silicone Co.) | 3.5 ml |
| (4) | Saponin 50% aq, solution | 4 ml |
| (5) | Matting agent dispersion-1 | 10 ml |
| (6) | Surfactant 1 (6% solution) | 4 ml |
| (7) | Water to make | 1000 ml |
| PVA203: | saponification degree of 88%, av. polymerization degree = 300 | |

-continued

| | |
|---|---|
| PVA235: | saponification degree of 88%, av. polymerization degree = 3500 |
| PVA245: | saponification degree of 88%, av. polymerization degree = 4500 |

AO-1

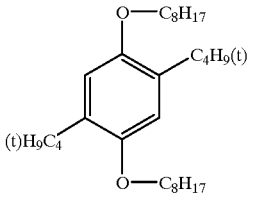

Surfactant 1

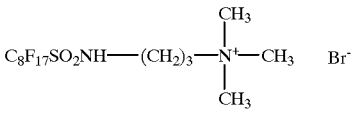

The thus obtained coating solutions were each filtered with the following filters:

1st and 2nd layer: two-step filtration with TCP10, available from TOYO ROSHI Co., Ltd.

$3^{rd}$ layer: two-step filtration with TCP30, available from TOYO ROSHI Co., Ltd.

On the polyolefin double coated support, the $1^{st}$ layer (40 μm), $2^{nd}$ layer (110 μm) and $3^{rd}$ layer (30 μm) were each coated in this order, in which values designated in parentheses indicated a wet layer thickness.

Coating solutions maintained at 40° C. were coated by a three layer-type slide hopper coater and maintained in the cooling zone maintained at 8° C. for 20 sec. immediately after coating. Then, after drying with 20 to 30° C. air for 60 sec., drying with 45° C. air for 60 sec. and drying with 50° C. air for 60 sec., re-humidifying was conducted at 23° C. and 40 to 60% RH to obtain recording sheet samples Nos. 1 through 14. Sample No. 15 was also obtained similarly to sample No. 6, except that 30 ml of an 20% aqueous solution of a thioether type antioxidant ($HO—C_2H_4—C_2H_4—S—C_2H_4OH$) was further added into the 2nd layer coating solution.

The thus obtained recording sheets were measured with respect to (i) Ra, Rz and Rmax of the surface of the ink absorbing layer side and (ii) surface glossiness (60°) of the surface of the ink absorbing layer side, and were also evaluated with respect to the number of cracking flaws in the ink absorbing layer (number/$m^2$). Further, black solid printing was conducted using an ink jet printer (PM770C, available from Seiko-Epson Co., Ltd.), then, the 60° glossiness was measured and evaluation was made with respect to unevenness of solid density and glare.

TABLE 1

| Recording Sheet | Ra | Rz | Rz/Ra | Rmax | Glossiness White Background | Glossiness Black Solid | Unevenness Black Solid Area | Glare Black Solid Area | Cracking |
|---|---|---|---|---|---|---|---|---|---|
| 1 (Comp.) | 0.25 | 3.23 | 12.9 | 3.42 | 38.9 | 46.2 | None | None | 0 |
| 2 (Comp.) | 0.44 | 1.78 | 4.0 | 2.11 | 22.1 | 32.4 | None | Present | 0 |
| 3 (Inv.) | 0.46 | 4.38 | 9.5 | 4.68 | 33.2 | 38.2 | None | None | 0 |
| 4 (Inv.) | 0.52 | 9.28 | 17.9 | 10.15 | 32.8 | 35.2 | Slightly | None | 0 |
| 5 (Inv.) | 0.73 | 7.21 | 9.9 | 7.38 | 29.5 | 32.4 | None | None | 0 |
| 6 (Inv.) | 0.86 | 10.21 | 11.9 | 10.82 | 28.3 | 30.4 | None | None | 0 |
| 7 (Inv.) | 0.92 | 12.64 | 13.7 | 13.63 | 28.1 | 31.2 | None | None | 1 |
| 8 (Inv.) | 1.03 | 18.12 | 17.6 | 19.81 | 27.7 | 32.1 | Slightly | None | 4 |
| 9 (Comp.) | 1.05 | 24.81 | 23.6 | 25.71 | 30.2 | 36.1 | Present | None | 17 |
| 10 (Comp.) | 1.30 | 5.01 | 3.9 | 5.34 | 14.2 | 23.8 | None | Present | 0 |
| 11 (Inv.) | 1.43 | 14.23 | 10.0 | 15.58 | 19.2 | 22.3 | None | None | 2 |
| 12 (Inv.) | 1.85 | 19.16 | 10.4 | 21.03 | 13.5 | 15.9 | None | None | 6 |
| 13 (Inv.) | 2.12 | 17.32 | 8.2 | 18.16 | 12.1 | 13.5 | Slightly | None | 3 |
| 14 (Comp.) | 2.75 | 27.23 | 9.9 | 29.01 | 8.2 | 11.7 | Present | None | 22 |
| 15 (Inv.) | 0.87 | 10.22 | 11.7 | 10.83 | 28.2 | 30.3 | None | None | 0 |

As apparent from Table 1, recording sheets Nos. 3 through 8 and 11 through 13 according to this invention, having a Ra of 0.4 to 2.5 and a Rz/Ra of 5 to 20 exhibited a glossiness of white background of 10 to 30%, resulting in optimally restrained gloss and relatively small variation in glossiness in imaging areas. Further, in the recording sheets according to this invention, there was no occurrence of marked unevenness and glare in black solid areas. Recording sheets Nos. 5 through 8 and 11, which exhibited Ra of 0.5 to 2.0 μm, a Rz/Ra of 7 to 15 and a white background glossiness of 12 to 30%, are specifically preferred. It was further noted that cracking in the ink absorbing layer increased along with an increase of Rz, specifically at a Rz of not more than 20.

Example 2

Recording sheets Nos. 1A through 14A were prepared similarly to Example 1, provided that silica used in the ink absorbing layer was replaced by silica prepared by a gas phase process (A300, average primary particle size of 7 mm, available from Nippon Aerogyl Co.). The recording sheets were also evaluated similarly to Example 1 and results are shown in Table 2.

TABLE 2

| Recording Sheet | Ra | Rz | Rz/Ra | Rmax | Glossiness White Background | Glossiness Black Solid | Unevenness Black Solid Area | Glare Black Solid Area | Cracking |
|---|---|---|---|---|---|---|---|---|---|
| 1A (Comp.) | 0.24 | 3.21 | 13.4 | 3.40 | 43.5 | 48.7 | None | None | 0 |
| 2A (Comp.) | 0.43 | 1.77 | 4.1 | 2.04 | 19.4 | 37.7 | None | Present | 0 |
| 3A (Inv.) | 0.45 | 4.30 | 9.6 | 4.41 | 34.4 | 38.2 | None | None | 0 |
| 4A (Inv.) | 0.52 | 9.23 | 17.8 | 9.97 | 33.9 | 38.3 | Slightly | None | 0 |
| 5A (Inv.) | 0.72 | 7.16 | 9.9 | 7.42 | 30.4 | 33.5 | None | None | 0 |
| 6A (Inv.) | 0.85 | 10.08 | 11.9 | 10.52 | 29.7 | 32.1 | None | None | 1 |
| 7A (Inv.) | 0.92 | 12.51 | 13.6 | 13.51 | 29.3 | 31.8 | None | None | 2 |
| 8A (Inv.) | 1.02 | 18.00 | 17.6 | 18.86 | 28.5 | 31.3 | Slightly | None | 6 |
| 9A (Comp.) | 1.05 | 24.70 | 23.5 | 25.36 | 32.2 | 39.5 | Present | None | 22 |
| 10A (Comp.) | 1.29 | 4.98 | 3.9 | 5.21 | 15.8 | 24.3 | None | Present | 1 |
| 11A (Inv.) | 1.43 | 14.09 | 9.9 | 15.45 | 21.5 | 24.6 | None | None | 3 |
| 12A (Inv.) | 1.83 | 18.99 | 10.4 | 19.83 | 15.8 | 17.4 | None | None | 8 |
| 13A (Inv.) | 2.10 | 17.28 | 8.2 | 17.85 | 13.6 | 15.8 | Slightly | None | 5 |
| 14A (Comp.) | 2.74 | 27.19 | 9.9 | 28.10 | 9.3 | 11.3 | Present | None | 38 |

As apparent from Table 2, the use of silica having a smaller size also led to the results similar to Example 1.

Example 3

Recording sheets Nos. 1B through 14B were prepared similarly to Example 1, provided that the matting agent used in the ink absorbing layer (average particle size of 15 μm) was replaced by a matting agent (average particle size of 3 μm). The recording sheets were also evaluated similarly to Example 1 and results in Table 3.

TABLE 3

| Recording Sheet | Ra | Rz | Rz/Ra | Rmax | Glossiness White Background | Glossiness Black Solid | Unevenness Black Solid Area | Glare Black Solid Area | Cracking |
|---|---|---|---|---|---|---|---|---|---|
| 1B (Comp.) | 0.23 | 3.14 | 13.6 | 3.29 | 39.9 | 43.2 | None | None | 0 |
| 2B (Comp.) | 0.42 | 1.66 | 4.0 | 1.92 | 20.1 | 29.6 | None | Present | 0 |
| 3B (Inv.) | 0.45 | 4.29 | 9.5 | 4.47 | 24.8 | 28.0 | None | None | 0 |
| 4B (Inv.) | 0.50 | 9.21 | 18.4 | 9.51 | 22.6 | 26.2 | Slightly | None | 0 |
| 5B (Inv.) | 0.70 | 7.17 | 10.2 | 7.25 | 21.0 | 22.9 | None | None | 0 |
| 6B (Inv.) | 0.86 | 10.21 | 11.9 | 10.82 | 19.7 | 22.5 | None | None | 1 |
| 7B (Inv.) | 0.90 | 12.32 | 13.7 | 13.57 | 18.4 | 20.7 | None | None | 3 |
| 8B (Inv.) | 1.00 | 17.56 | 17.6 | 18.67 | 16.2 | 20.3 | Slightly | None | 7 |
| 9B (Comp.) | 1.03 | 23.79 | 23.1 | 24.92 | 17.5 | 21.9 | Present | None | 23 |
| 10B (Comp.) | 1.27 | 4.91 | 3.9 | 5.31 | 9.7 | 16.3 | None | Present | 2 |
| 11B (Inv.) | 1.38 | 13.95 | 10.1 | 14.77 | 11.7 | 15.0 | None | None | 2 |
| 12B (Inv.) | 1.78 | 18.76 | 10.5 | 19.39 | 10.2 | 13.0 | None | None | 9 |
| 13B (Inv.) | 2.07 | 17.02 | 8.2 | 17.81 | 9.3 | 11.7 | Slightly | None | 7 |
| 14B (Comp.) | 2.68 | 26.18 | 9.8 | 27.05 | 7.2 | 9.9 | Present | None | 49 |

As apparent from Table 3, even when a matting agent having a small size was used to lower gloss of the 3rd layer, advantageous effects of this invention were achieved.

What is claimed is:

1. An ink jet recording sheet comprising a support having on at least one side of the support an ink absorbing layer, wherein the surface of the ink absorbing layer side of the sheet exhibits a center-line mean roughness (Ra) of 0.4 to 2.5 $\mu$m and a ten-point mean roughness (Rz) of 5×Ra to 20×Ra when measured at a reference length of 2.5 mm and a cut-off value of 0.8 mm, and wherein the ink absorbing layer is a porous coat containing voids and containing fine inorganic particles and a hydrophilic polymer in a ratio by weight of the inorganic particles to the hydrophilic polymer of 2 to 20.

2. The ink jet recording sheet of claim 1, wherein the Ra is 0.5 to 2.0 $\mu$m and the Rz is 7×Ra to 15×Ra.

3. The ink jet recording sheet of claim 1, wherein the support is a polyolefin resin coated paper.

4. The ink jet recording sheet of claim 3, wherein the surface of the ink absorbing layer side of the support exhibits a Ra of 0.6 to 4.0 $\mu$m, a Rz of 4 to 30 $\mu$m and a Rz/Ra of 5 to 30.

5. The ink recording sheet of claim 4, wherein the Ra is 1.0 to 3.5 $\mu$m and the Rz is 5 to 25 $\mu$m.

6. The ink recording sheet of claim 3, wherein the surface of the ink absorbing layer side of the support exhibits a specular glossiness at an angle of 60 degrees of 10 to 35%.

7. The ink recording sheet of claim 6, wherein the specular glossiness at an angle of 60 degrees is 12 to 30%.

8. The ink jet recording sheet of claim 1, wherein the inorganic particles are at least one selected from the group consisting of silica, colloidal silica and pseude-boehmite.

9. The ink jet recording sheet of claim 8, wherein the inorganic particles are silica.

10. The ink jet recording sheet of claim 1, wherein the hydrophilic polymer is at least one selected from the group consisting of gelatin, polyvinyl alcohol, polyvinyl pyrrolidone, polyethylene oxide, hydroxyethyl cellulose, agar, pullulan, dextran, polyacrylic acid, carboxymethyl cellulose, casein and alginic acid.

11. The ink jet recording sheet of claim 10, wherein the hydrophilic polymer is polyvinyl alcohol.

* * * * *